US011812810B2

(12) United States Patent
Pomering

(10) Patent No.: US 11,812,810 B2
(45) Date of Patent: Nov. 14, 2023

(54) HELMET

(71) Applicant: MIPS AB, Täby (SE)

(72) Inventor: Amy Louise Pomering, Täby (SE)

(73) Assignee: MIPS AB

( * ) Notice: Subject to any disclaimer, the term of this patent is extended or adjusted under 35 U.S.C. 154(b) by 647 days.

(21) Appl. No.: 16/960,259

(22) PCT Filed: Jan. 4, 2019

(86) PCT No.: PCT/EP2019/050173
§ 371 (c)(1),
(2) Date: Jul. 6, 2020

(87) PCT Pub. No.: WO2019/134974
PCT Pub. Date: Jul. 11, 2019

(65) Prior Publication Data

US 2020/0359727 A1 Nov. 19, 2020

(30) Foreign Application Priority Data

Jan. 8, 2018 (GB) ..... 1800255

(51) Int. Cl.
*A42B 3/06* (2006.01)

(52) U.S. Cl.
CPC ..... *A42B 3/064* (2013.01)

(58) Field of Classification Search
CPC ..... A42B 3/04; A42B 3/063; A42B 3/064; A42B 3/12; A42B 3/147
See application file for complete search history.

(56) References Cited

U.S. PATENT DOCUMENTS

| | | | | |
|---|---|---|---|---|
| 2001/0032351 | A1 | 10/2001 | Nakayama et al. | |
| 2004/0045078 | A1 | 3/2004 | Puchalski | |
| 2004/0117896 | A1* | 6/2004 | Madey | A42B 3/064 2/425 |
| 2004/0250340 | A1* | 12/2004 | Piper | A42B 3/064 2/412 |
| 2012/0060251 | A1 | 3/2012 | Schimpf | |
| 2012/0198604 | A1 | 8/2012 | Weber et al. | |
| 2013/0061371 | A1 | 3/2013 | Phipps et al. | |
| 2013/0185837 | A1 | 7/2013 | Phipps et al. | |
| 2013/0283507 | A1 | 10/2013 | Baty | |
| 2014/0013492 | A1 | 1/2014 | Bottlang et al. | |
| 2016/0088884 | A1 | 3/2016 | Guerra | |
| 2016/0316829 | A1 | 11/2016 | Guerra | |
| 2016/0369861 | A1 | 12/2016 | Phipps et al. | |
| 2017/0105470 | A1 | 4/2017 | Eaton | |

(Continued)

FOREIGN PATENT DOCUMENTS

| | | | |
|---|---|---|---|
| CN | 1316207 | A | 10/2001 |
| CN | 102406262 | A | 4/2012 |

(Continued)

*Primary Examiner* — Sally Haden
(74) *Attorney, Agent, or Firm* — Perkins Coie LLP

(57) ABSTRACT

A helmet comprising: an inner shell; an outer shell, configured to be able to displace relative to the inner shell in response to an impact; and an impact response adjustment mechanism configured to be adjustable such that the response profile of the relative displacement over time of the outer shell in relation to the inner shell in response to an impact on the helmet varies depending on the setting of the impact response adjustment mechanism.

18 Claims, 6 Drawing Sheets

(56) References Cited

U.S. PATENT DOCUMENTS

| | | | |
|---|---|---|---|
| 2017/0112220 | A1 | 4/2017 | Suddaby |
| 2017/0119080 | A1 | 5/2017 | Allen et al. |
| 2018/0153243 | A1 | 6/2018 | Pradeep |

FOREIGN PATENT DOCUMENTS

| | | | |
|---|---|---|---|
| CN | 104427896 | A | 3/2015 |
| CN | 107847002 | A | 3/2018 |
| WO | WO 96/14768 | | 5/1996 |
| WO | WO 2001/045526 | | 6/2001 |
| WO | WO 2008/103107 | | 8/2008 |
| WO | WO 2011/139224 | | 11/2011 |
| WO | WO 2016/077503 | | 5/2016 |
| WO | WO 2018/197207 | | 11/2018 |

* cited by examiner

HELMET

RELATED APPLICATIONS

This application is a 35 USC § 371 National Stage application of International Application No. PCT/EP2019/050173, entitled "HELMET," filed on Jan. 4, 2019, which claims the benefit of United Kingdom Patent Application No. 1800255.0, filed on Jan. 8, 2018 the disclosures of which applications are incorporated herein by reference in their entireties.

The present invention relates to helmets.

Helmets are known for use in various activities. These activities include combat and industrial purposes, such as protective helmets for soldiers and hard-hats or helmets used by builders, mine-workers, or operators of industrial machinery for example. Helmets are also common in sporting activities. For example, protective helmets may be used in ice hockey, cycling, motorcycling, motor-car racing, skiing, snow-boarding, skating, skateboarding, equestrian activities, American football, baseball, rugby, cricket, lacrosse, climbing, golf, airsoft and paintballing.

Helmets can be of fixed size or adjustable, to fit different sizes and shapes of head. In some types of helmet, e.g. commonly in ice-hockey helmets, the adjustability can be provided by moving parts of the helmet to change the outer and inner dimensions of the helmet. This can be achieved by having a helmet with two or more parts which can move with respect to each other. In other cases, e.g. commonly in cycling helmets, the helmet is provided with an attachment device for fixing the helmet to the user's head, and it is the attachment device that can vary in dimension to fit the user's head whilst the main body or shell of the helmet remains the same size. In some cases, comfort padding within the helmet can act as the attachment device. The attachment device can also be provided in the form of a plurality of physically separate parts, for example a plurality of comfort pads which are not interconnected with each other. Such attachment devices for seating the helmet on a user's head may be used together with additional strapping (such as a chin strap) to further secure the helmet in place. Combinations of these adjustment mechanisms are also possible.

Helmets are often made of an outer shell, that is usually hard and made of a plastic or a composite material, and an energy absorbing layer called a liner. Nowadays, a protective helmet has to be designed so as to satisfy certain legal requirements which relate to inter alia the maximum acceleration that may occur in the centre of gravity of the brain at a specified load. Typically, tests are performed, in which what is known as a dummy skull equipped with a helmet is subjected to a radial blow towards the head. This has resulted in modern helmets having good energy-absorption capacity in the case of blows radially against the skull. Progress has also been made (e.g. WO 2001/045526 and WO 2011/139224, which are both incorporated herein by reference, in their entireties) in developing helmets to lessen the energy transmitted from oblique blows (i.e. which combine both tangential and radial components), by absorbing or dissipating rotation energy and/or redirecting it into translational energy rather than rotational energy.

Such oblique impacts (in the absence of protection) result in both translational acceleration and angular acceleration of the brain. Angular acceleration causes the brain to rotate within the skull creating injuries on bodily elements connecting the brain to the skull and also to the brain itself.

Examples of rotational injuries include concussion, subdural haematomas (SDH), bleeding as a consequence of blood vessels rapturing, and diffuse axonal injuries (DAI), which can be summarized as nerve fibres being over stretched as a consequence of high shear deformations in the brain tissue.

Depending on the characteristics of the rotational force, such as the duration, amplitude and rate of increase, either SDH, DAI or a combination of these injuries can be suffered. Generally speaking, SDH occur in the case of accelerations of short duration and great amplitude, while DAI occur in the case of longer and more widespread acceleration loads.

As discussed in the above-referenced patent applications, helmets have been developed in which a sliding interface may be provided between two shells of the helmet in order to assist with management of an oblique impact. However, the present inventors have identified that, for some uses, it may be desirable to make adjustments to the way in which the inner and outer shell move relative to each other in response to loading. For example, this may be of interest to a user if the helmet is to be used in a plurality of circumstances in which expected conditions may differ. It may also be of interest to the user if optional components or other items that may add weight may be mounted to the helmet and may affect the behaviour of the helmet, both in the event of an impact and in normal use. Additional components that may be added to a helmet may include, for example, cameras and/or position-tracking devices.

The present invention aims to at least partially address this problem.

According to the present invention, there is provided a helmet comprising an inner shell, an outer shell, configured to be able to displace relative to the inner shell in response to an impact. The helmet further includes an impact response adjustment mechanism configured to be adjustable such that the response profile of the relative displacement over time of the outer shell in relation to the inner shell in response to an impact on the helmet varies depending on the setting of the impact response adjustment mechanism.

The invention is described below by way of non-limiting examples, with reference to the accompanying drawings, in which.

Figure 1:
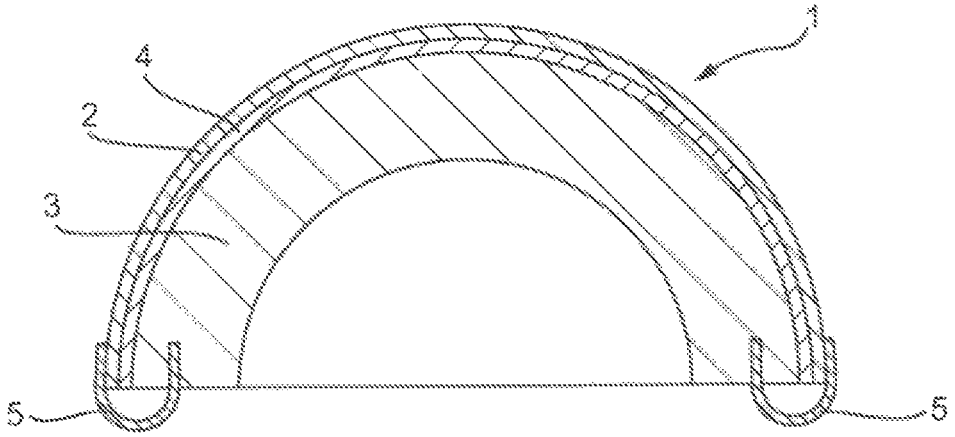
FIG. 1 depicts a cross section through a helmet for providing protection against oblique impacts.

The proportions of the thicknesses of the various layers in the helmets depicted in the figures have been exaggerated in the drawings for the sake of clarity and can of course be adapted according to need and requirements.

FIG. 1 depicts a first helmet 1 of the sort discussed in WO 01/45526, intended for providing protection against oblique impacts. This type of helmet could be any of the types of helmet discussed above.

Protective helmet 1 is constructed with an outer shell 2 and, arranged inside the outer shell 2, an inner shell 3 that is intended for contact with the head of the wearer.

Arranged between the outer shell 2 and the inner shell 3 is a sliding layer 4 or a sliding facilitator, and thus makes possible displacement between the outer shell 2 and the inner shell 3. In particular, as discussed below, a sliding layer 4 or sliding facilitator may be configured such that sliding may occur between two parts during an impact. For example, it may be configured to enable sliding under forces associated with an impact on the helmet 1 that is expected to be survivable for the wearer of the helmet 1. In some arrangements, it may be desirable to configure the sliding layer or sliding facilitator such that the coefficient of friction is between 0.001 and 0.3 and/or below 0.15.

Arranged in the edge portion of the helmet 1, in the FIG. 1 depiction, may be one or more connecting members 5 which interconnect the outer shell 2 and the inner shell 3. In some arrangements, the connectors may counteract mutual displacement between the outer shell 2 and the inner shell 3 by absorbing energy. However, this is not essential. Further, even where this feature is present, the amount of energy absorbed is usually minimal in comparison to the energy absorbed by the inner shell 3 during an impact. In other arrangements, connecting members 5 may not be present at all.

Further, the location of these connecting members 5 can be varied (for example, being positioned away from the edge portion, and connecting the outer shell 2 and the inner shell 3 through the sliding layer 4).

The outer shell 2 is preferably relatively thin and strong so as to withstand impact of various types. The outer shell 2 could be made of a polymer material such as polycarbonate (PC), polyvinylchloride (PVC) or acrylonitrile butadiene styrene (ABS) for example. Advantageously, the polymer material can be fibre-reinforced, using materials such as glass-fibre, Aramid, Twaron, carbon-fibre or Kevlar.

The inner shell 3 is considerably thicker and acts as an energy absorbing layer. As such, it is capable of damping or absorbing impacts against the head. It can advantageously be made of foam material like expanded polystyrene (EPS), expanded polypropylene (EPP), expanded polyurethane (EPU), vinyl nitrile foam; or other materials forming a honeycomb-like structure, for example; or strain rate sensitive foams such as marketed under the brand-names Poron™ and D3O™. The construction can be varied in different ways, which emerge below, with, for example, a number of layers of different materials.

Inner shell 3 is designed for absorbing the energy of an impact. Other elements of the helmet 1 will absorb that energy to a limited extend (e.g. the hard outer shell 2 or so-called 'comfort padding' provided within the inner shell 3), but that is not their primary purpose and their contribution to the energy absorption is minimal compared to the energy absorption of the inner shell 3. Indeed, although some other elements such as comfort padding may be made of 'compressible' materials, and as such considered as 'energy absorbing' in other contexts, it is well recognised in the field of helmets that compressible materials are not necessarily 'energy absorbing' in the sense of absorbing a meaningful amount of energy during an impact, for the purposes of reducing the harm to the wearer of the helmet.

A number of different materials and embodiments can be used as the sliding layer 4 or sliding facilitator, for example oil, Teflon, microspheres, air, rubber, polycarbonate (PC), a fabric material such as felt, etc. Such a layer may have a thickness of roughly 0.1-5 mm, but other thicknesses can also be used, depending on the material selected and the performance desired. The number of sliding layers and their positioning can also be varied, and an example of this is discussed below (with reference to FIG. 3B).

As connecting members 5, use can be made of, for example, deformable strips of plastic or metal which are anchored in the outer shell and the inner shell in a suitable manner.

Figure 2:
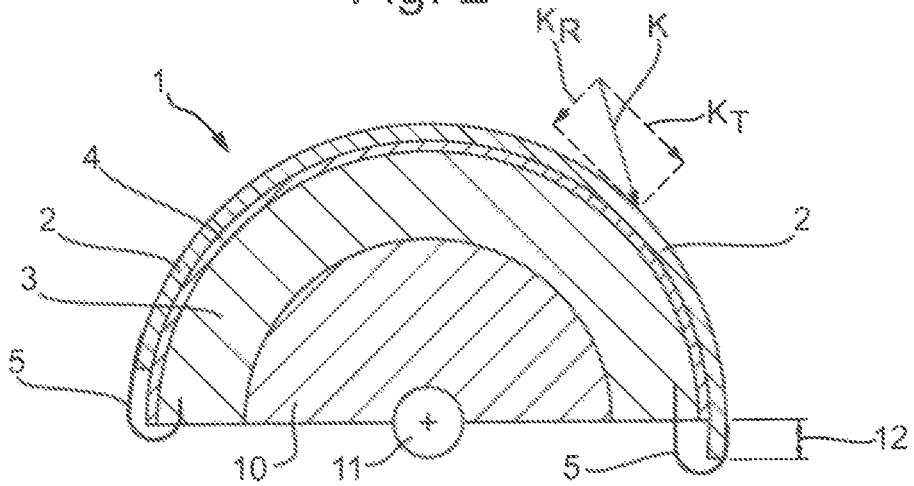
FIG. 2 is a diagram showing the functioning principle of the helmet of FIG. 1.

FIG. 2 shows the functioning principle of protective helmet 1, in which the helmet 1 and a skull 10 of a wearer are assumed to be semi-cylindrical, with the skull 10 being mounted on a longitudinal axis 11. Torsional force and torque are transmitted to the skull 10 when the helmet 1 is subjected to an oblique impact K. The impact force K gives rise to both a tangential force $K_T$ and a radial force KR against the protective helmet 1. In this particular context, only the helmet-rotating tangential force $K_T$ and its effect are of interest.

As can be seen, the force K gives rise to a displacement 12 of the outer shell 2 relative to the inner shell 3, the connecting members 5 being deformed. A reduction in the torsional force transmitted to the skull 10 of roughly 25% can be obtained with such an arrangement. This is a result of the sliding motion between the inner shell 3 and the outer shell 2 reducing the amount of energy which is transferred into radial acceleration.

Sliding motion can also occur in the circumferential direction of the protective helmet 1, although this is not depicted. This can be as a consequence of circumferential angular rotation between the outer shell 2 and the inner shell 3 (i.e. during an impact the outer shell 2 can be rotated by a circumferential angle relative to the inner shell 3).

Figure 3A:
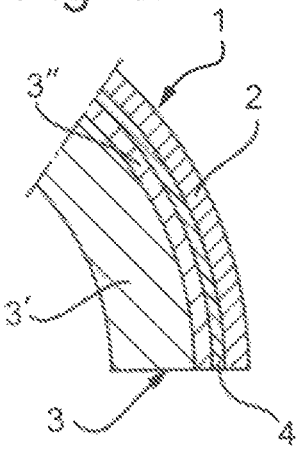
FIGS. 3A, 3B & 3C show variations of the structure of the helmet of FIG. 1.
Figure 3B:
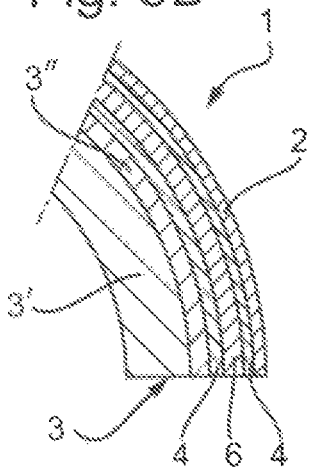
Figure 3C:
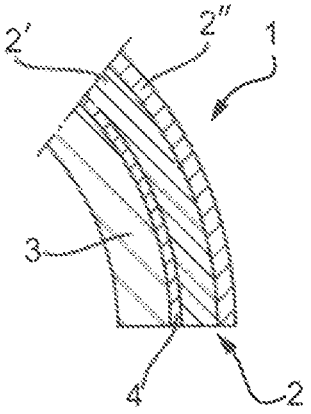

Other arrangements of the protective helmet 1 are also possible. A few possible variants are shown in FIG. 3. In FIG. 3*a*, the inner shell 3 is constructed from a relatively thin outer layer 3" and a relatively thick inner layer 3'. The outer layer 3" is preferably harder than the inner layer 3', to help facilitate the sliding with respect to outer shell 2. In FIG. 3*b*, the inner shell 3 is constructed in the same manner as in FIG. 3*a*. In this case, however, there are two sliding layers 4, between which there is an intermediate shell 6. The two sliding layers 4 can, if so desired, be embodied differently and made of different materials. One possibility, for example, is to have lower friction in the outer sliding layer than in the inner. In FIG. 3*c*, the outer shell 2 is embodied differently to previously. In this case, a harder outer layer 2" covers a softer inner layer 2'. The inner layer 2' may, for example, be the same material as the inner shell 3.

Figure 4:
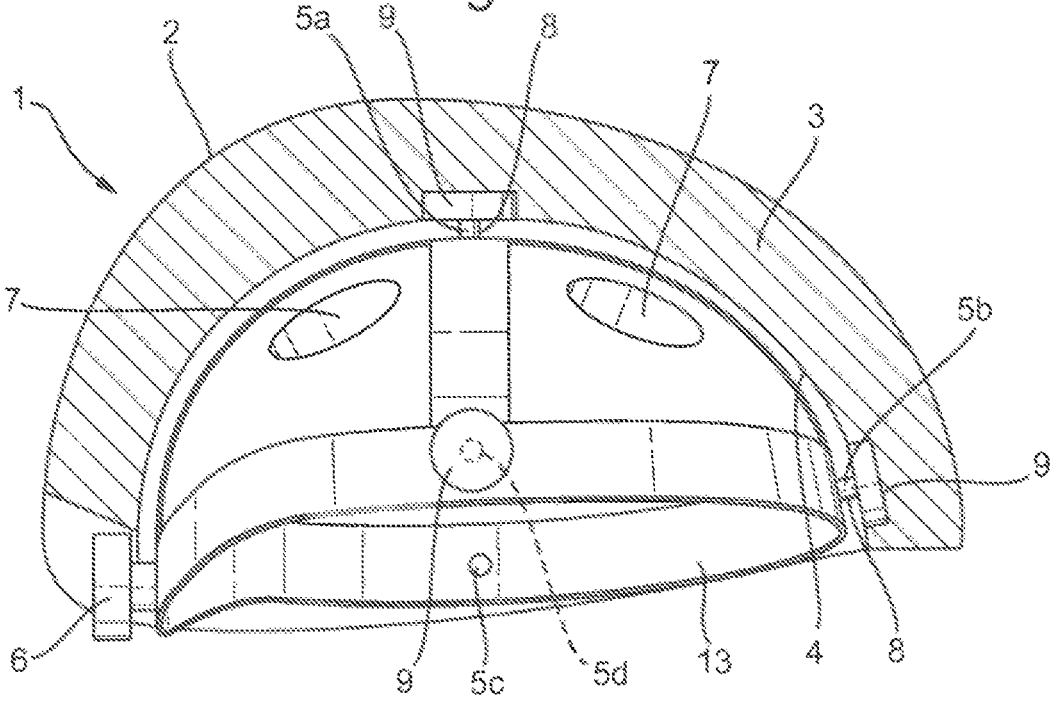
FIG. 4 is a schematic drawing of a another protective helmet.

FIG. 4 depicts a second helmet 1 of the sort discussed in WO 2011/139224, which is also intended for providing protection against oblique impacts. This type of helmet could also be any of the types of helmet discussed above.

In FIG. 4, helmet 1 comprises an energy absorbing layer 3, similar to the inner shell 3 of the helmet of FIG. 1. The outer surface of the energy absorbing layer 3 may be provided from the same material as the energy absorbing layer 3 (i.e. there may be no additional outer shell), or the outer surface could be a rigid shell 2 (see FIG. 5) equivalent to the outer shell 2 of the helmet shown in FIG. 1. In that case, the rigid shell 2 may be made from a different material than the energy absorbing layer 3. The helmet 1 of FIG. 4 has a plurality of vents 7, which are optional, extending through both the energy absorbing layer 3 and the outer shell 2, thereby allowing airflow through the helmet 1.

An attachment device 13 is provided, for attachment of the helmet 1 to a wearer's head. As previously discussed, this may be desirable when energy absorbing layer 3 and rigid shell 2 cannot be adjusted in size, as it allows for the different size heads to be accommodated by adjusting the size of the attachment device 13. The attachment device 13 could be made of an elastic or semi-elastic polymer material, such as PC, ABS, PVC or PTFE, or a natural fibre material such as cotton cloth. For example, a cap of textile or a net could form the attachment device 13.

Although the attachment device 13 is shown as comprising a headband portion with further strap portions extending from the front, back, left and right sides, the particular configuration of the attachment device 13 can vary according to the configuration of the helmet. In some cases the attachment device may be more like a continuous (shaped) sheet, perhaps with holes or gaps, e.g. corresponding to the positions of vents 7, to allow air-flow through the helmet.

FIG. 4 also depicts an optional adjustment device 6 for adjusting the diameter of the head band of the attachment device 13 for the particular wearer. In other arrangements, the head band could be an elastic head band in which case the adjustment device 6 could be excluded.

A sliding facilitator 4 is provided radially inwards of the energy absorbing layer 3. The sliding facilitator 4 is adapted to slide against the energy absorbing layer or against the attachment device 13 that is provided for attaching the helmet to a wearer's head.

The sliding facilitator 4 is provided to assist sliding of the energy absorbing layer 3 in relation to an attachment device 13, in the same manner as discussed above. The sliding facilitator 4 may be a material having a low coefficient of friction, or may be coated with such a material.

As such, in the FIG. 4 helmet, the sliding facilitator may be provided on or integrated with the innermost sided of the energy absorbing layer 3, facing the attachment device 13.

However, it is equally conceivable that the sliding facilitator 4 may be provided on or integrated with the outer surface of the attachment device 13, for the same purpose of providing slidability between the energy absorbing layer 3 and the attachment device 13. That is, in particular arrangements, the attachment device 13 itself can be adapted to act as a sliding facilitator 4 and may comprise a low friction material.

In other words, the sliding facilitator 4 is provided radially inwards of the energy absorbing layer 3. The sliding facilitator can also be provided radially outwards of the attachment device 13.

When the attachment device 13 is formed as a cap or net (as discussed above), sliding facilitators 4 may be provided as patches of low friction material.

The low friction material may be a waxy polymer, such as PTFE, ABS, PVC, PC, Nylon, PFA, FEP, PE and UHMWPE, or a powder material which could be infused with a lubricant. The low friction material could be a fabric material. As discussed, this low friction material could be applied to either one, or both of the sliding facilitator and the energy absorbing layer The attachment device 13 can be fixed to the energy absorbing layer 3 and/or the outer shell 2 by means of fixing members 5, such as the four fixing members 5*a*, 5*b*, 5*c* and 5*d* in FIG. 4. These may be adapted to absorb energy by deforming in an elastic, semi-elastic or plastic way. However, this is not essential. Further, even where this feature is present, the amount of energy absorbed is usually minimal in comparison to the energy absorbed by the energy absorbing layer 3 during an impact.

According to the embodiment shown in FIG. 4 the four fixing members 5*a*, 5*b*, 5*c* and 5*d* are suspension members 5*a*, 5*b*, 5*c*, 5*d*, having first and second portions 8, 9, wherein the first portions 8 of the suspension members 5*a*, 5*b*, 5*c*, 5*d* are adapted to be fixed to the attachment device 13, and the second portions 9 of the suspension members 5*a*, 5*b*, 5*c*, 5*d* are adapted to be fixed to the energy absorbing layer 3.

Figure 5:
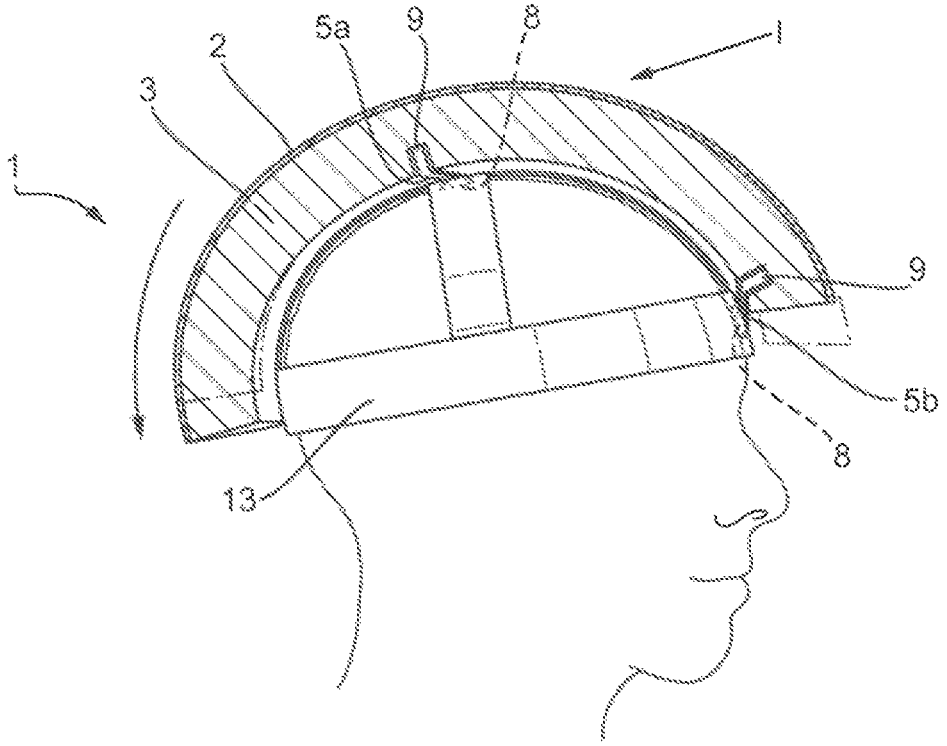
FIG. 5 depicts an alternative way of connecting the attachment device of the helmet of FIG. 4.

FIG. 5 shows an embodiment of a helmet similar to the helmet in FIG. 4, when placed on a wearers' head. The helmet 1 of FIG. 5 comprises a hard outer shell 2 made from a different material than the energy absorbing layer 3. In contrast to FIG. 4, in FIG. 5 the attachment device 13 is fixed to the energy absorbing layer 3 by means of two fixing members 5*a*, 5*b*, which are adapted to absorb energy and forces elastically, semi-elastically or plastically.

A frontal oblique impact I creating a rotational force to the helmet is shown in FIG. 5. The oblique impact I causes the energy absorbing layer 3 to slide in relation to the attachment device 13. The attachment device 13 is fixed to the energy absorbing layer 3 by means of the fixing members 5*a*, 5*b*. Although only two such fixing members are shown, for the sake of clarity, in practice many such fixing members may be present. The fixing members 5 can absorb the rotational forces by deforming elastically or semi-elastically. In other arrangements, the deformation may be plastic, even resulting in the severing of one or more of the fixing members 5. In the case of plastic deformation, at least the fixing members 5 will need to be replaced after an impact. In some case a combination of plastic and elastic deformation in the fixing members 5 may occur, i.e. some fixing members 5 rupture, absorbing energy plastically, whilst other fixing members deform and absorb forces elastically.

In general, in the helmets of FIG. 4 and FIG. 5, during an impact the energy absorbing layer 3 acts as an impact absorber by compressing, in the same way as the inner shell of the FIG. 1 helmet. If an outer shell 2 is used, it will help spread out the impact energy over the energy absorbing layer 3. The sliding facilitator 4 will also allow sliding between the attachment device and the energy absorbing layer. This allows for a controlled way to dissipate energy that would otherwise be transmitted as rotational energy to the brain. The energy can be dissipated by friction heat, energy absorbing layer deformation or deformation or displacement of the fixing members. The reduced energy transmission results in reduced rotational acceleration affecting the brain, thus reducing the rotation of the brain within the skull. The risk of rotational injuries such as subdural haematomas, SDH, blood vessel rapturing, concussions and DAI is thereby reduced.

In an arrangement of the present invention, a helmet is provided with an impact response adjustment mechanism that is configured to enable adjustment of the response of the relative displacement between the inner shell and the outer shell in the event of an impact on the helmet. The displacement between the inner shell and the outer shell may be implemented by the provision of a sliding interface between the two shells. Alternatively, other arrangements may be provided, including but not limited to the provision of one or more components between the two shells that shear. It will be appreciated that, in such an arrangement, the inner and the outer surface of the one or more shearing components may be considered to be sliding relative to each other, enabling sliding of the shells relative to each other.

An adjustment mechanism may be configured such that a user can make adjustments in a controlled manner, for example enabling them to make an adjustment with an understanding of the expected effect of an adjustment that they make. This may be distinct from variations in the performance of a helmet that may arise from natural variations in the process of assembling a helmet.

The inner and outer shells of the helmet for which the impact response adjustment mechanism may adjust the relative displacement may, in general, be any two layers of a helmet between which a sliding interface, or other interface enabling relative displacement, is provided. In particular, such an impact response adjustment mechanism may be provided to any of the helmet arrangements discussed above.

For example, in an arrangement, the inner shell may be a layer that is configured to contact the head of the wearer and/or to be mounted to the head of the wearer and the outer shell may be an energy absorbing layer for absorbing impact energy. In another arrangement, the inner shell may be a first energy absorbing layer for absorbing impact energy and the outer shell may be a second energy absorbing layer for absorbing impact energy. In a further example, the inner shell may be an energy absorbing layer for absorbing impact energy and the outer shell may be a relatively hard shell, for example formed from a material that is harder than the material used to form the energy absorbing layer.

As is explained below in relation to specific examples of arrangements of the impact response adjustment mechanism, the impact response adjustment mechanism may be configured such that it can be manually adjusted by a wearer of the helmet. Accordingly, the adjustment of the impact response adjustment mechanism may be performed after a user has purchased a helmet rather than being set, for example, in the manufacturing/assembly process. A user may also be able to repeatedly adjust the impact response adjustment mechanism to different settings.

In some arrangements, a tool may be used in order to adjust the impact response adjustment mechanism. In other arrangements, the impact response adjustment mechanism may be configured such that the user can adjust the setting of the impact response adjustment mechanism without requiring the use of a tool. For example, the impact response adjustment mechanism may be configured such that changing the setting of the impact response adjustment mechanism may be effected using their hand/fingers.

In general, an impact response adjustment mechanism may be provided at any convenient point on a helmet. In some arrangements, the impact response adjustment mechanism may be provided at the edge of a helmet. This may be convenient for providing access for a user to the impact response adjustment mechanism. For example, this may permit the user to change the setting of the impact response adjustment mechanism while wearing the helmet. Alternatively or additionally, providing an impact response adjustment mechanism at an edge of a helmet may facilitate the manufacture of a helmet with such an impact response adjustment mechanism.

The impact response adjustment mechanism may enable adjustment of the response profile of the relative displacement over time between the inner shell and the outer shell. Accordingly, for a given magnitude of impact at a specific location on the helmet, a characteristic profile of the displacement over time of the outer shell relative to the inner shell over time may be altered by changing the setting of the impact response adjustment mechanism. Depending on the impact response adjustment mechanism used, the effect of the change may be to change at least one of the maximum relative velocity, the maximum rate of change of the relative velocity, namely the relative acceleration, the time above a threshold relative velocity and the time above a threshold relative acceleration.

As explained above, the comparison of the effect of the performance of a helmet for different settings of the impact response adjustment mechanism may be understood by considering the change of the response profile of the relative displacement over time between the inner shell and the outer shell for a given magnitude of impact at a specific location on the helmet. Such an impact may be a standard impact, namely of a standard impact force at a standard location. However, It should be appreciated that the effect of changing the setting of the impact response adjustment mechanism in a helmet may also be such that, for the different settings, the helmet may be able to withstand different levels of impact whilst having the same, or a similar, response profile of the relative displacement over time between the inner shell and the outer shell.

In an arrangement, the impact response adjustment mechanism includes a friction pad that is mounted on one of the inner shell and the outer shell and contacts an opposing surface on the other of the inner shell and the outer shell. In such an arrangement, the impact response adjustment mechanism may be configured such that changing the setting of the impact response adjustment mechanism adjusts the friction force between the friction pad and the opposing surface. In so doing, the response profile of the relative displacement over time of the outer shell relative to the inner shell is also adjusted.

Figure 6:
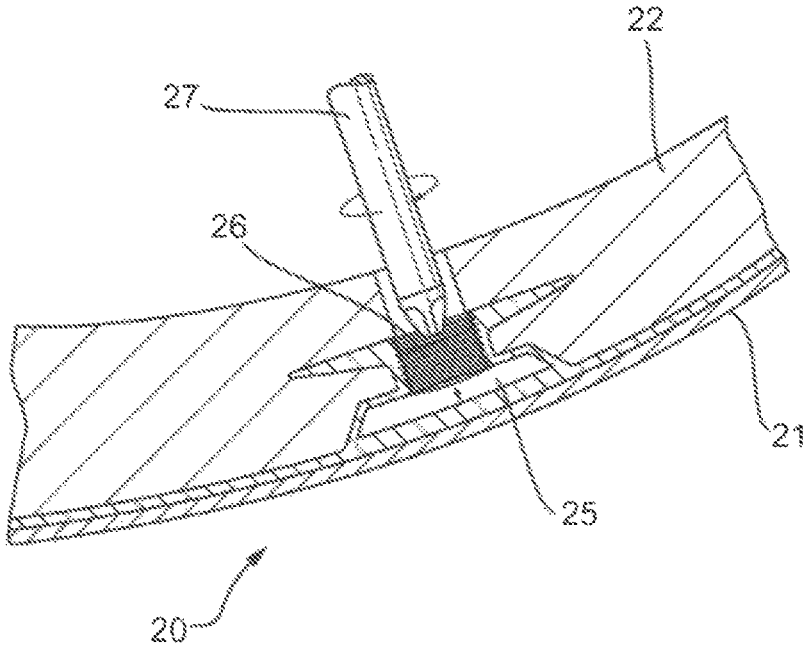
FIG. 6 depicts an arrangement for an impact response adjustment mechanism.

FIG. 6 depicts an arrangement of an impact response adjustment mechanism 20 that includes a friction pad 25 mounted on the inner shell 22 of a helmet. The surface of the friction pad 25 is arranged to oppose an inner surface of the outer shell 21. The friction pad 25 may include a surface having a coefficient of friction with the opposing surface that may be higher than the coefficient friction between the inner shell and the outer shell at the sliding interface. The friction pad 25 may also include a resilient portion, configured such that the further the resilient portion is advanced towards the opposing surface, the greater the reaction force between the surface of the friction pad 25 and the opposing surface.

In the arrangement depicted in FIG. 6, a rotating actuator 26 is provided in conjunction with the friction pad 25. When the rotating actuator 26 is rotated in a first direction, the friction pad 25 is advanced towards the opposing surface of the outer shell 21. When the rotating actuator is rotated in the opposite direction, the friction pad 25 is retracted away from the opposing surface of the outer shell 21. Accordingly, by adjusting the rotating actuator 26, the reaction force between the friction pad 25 and the opposing surface of the outer shell 21 may be changed, which in turn changes the response profile of the relative displacement over time of the outer shell in relation to the inner shell in response to an impact on the helmet.

It should be appreciated that, although in the arrangement depicted in FIG. 6 the impact response adjustment mechanism 20 is mounted to the inner shell 22 and includes a friction pad 25 that opposes the inner surface of the outer shell 21, the arrangement may be reversed. Accordingly, the impact response adjustment mechanism 20 may be mounted to the outer shell 21 and have a friction pad 25 that opposes an outer surface of the inner shell 22.

Similarly, although in the arrangement depicted in FIG. 6, the rotating actuator is depicted being adjusted by use of a tool 27, it should be appreciated, that in a variation, the rotating actuator 26 may be configured to be adjusted without the use of a tool. For example, it may have an integral user interface that can be adjusted manually by a user.

Furthermore, although in the arrangement depicted in FIG. 6, the impact response adjustment mechanism 20 may be configured such that the rotating actuator 26 is adjusted from the side of the sliding interface that corresponds to the shell on which it is mounted, variations are possible. For example, the arrangement depicted in FIG. 6 may be modified to include an opening through the outer shell 21 and the friction pad 25 that permit a tool 27 to be inserted from outside the helmet and to engage with the rotating actuator 26 in order to adjust the setting of the impact response adjustment mechanism 20.

In an arrangement, the impact response adjustment mechanism may comprise a controller that is configured to be operated by a user and may, in turn, control the friction pad to adjust the reaction force between the friction pad and the opposing surface.

In an arrangement such as that depicted in FIG. 6, the controller may be part of, or used in conjunction with, the rotating actuator 26. In other arrangements, the controller may be separated from the friction pad 25. Such an arrangement may enable the friction pad to be mounted at a location that is desirable for the operation of the impact response adjustment mechanism but for the controller to be provided at a location that is convenient for access by the user.

In an arrangement, the impact response adjustment mechanism may include at least one tensile element, such as a wire, band or tape that provides a connection between the controller and the friction pad. The controller may be configured such that it can adjust the tension in the wire, band or tape. The friction pad may be arranged such that the tension in the wire, band or tape determines the reaction force between the friction pad and the opposing surface against which it acts. Accordingly, by means of adjusting the controller, a user may adjust the friction between the inner and outer shell, adjusting the response profile of the relative displacement over time of the outer shell in relation to the inner shell in response to an impact on the helmet.

Figure 7:
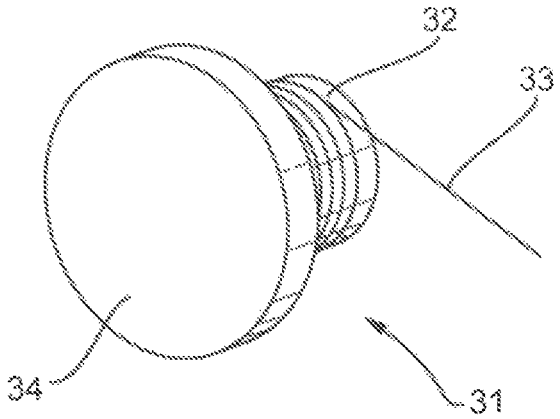
FIG. 7 depicts a controller for an arrangement of an impact response adjustment mechanism.

The controller may be provided by one of a number of arrangements. In a simple arrangement a controller 31 such as that depicted in FIG. 7 may be used. The controller 31 may include a rotatably mounted spool 32 about which the wire, band or tape 33 may be wound. A control knob 34 may be connected to the spool 32. In use, the user may turn the knob 34 in order to wind on, or wind off, the wire, band or tape 33 from the spool 32, adjusting the tension of the wire, band or tape. A ratchet or other similar mechanism may be provided arranged such that, when the user has set the control knob 34 to the desired position, it remains in the desired position when the user releases the control knob 34, maintaining the desired tension in the wire, band or tape 33.

Figure 8:
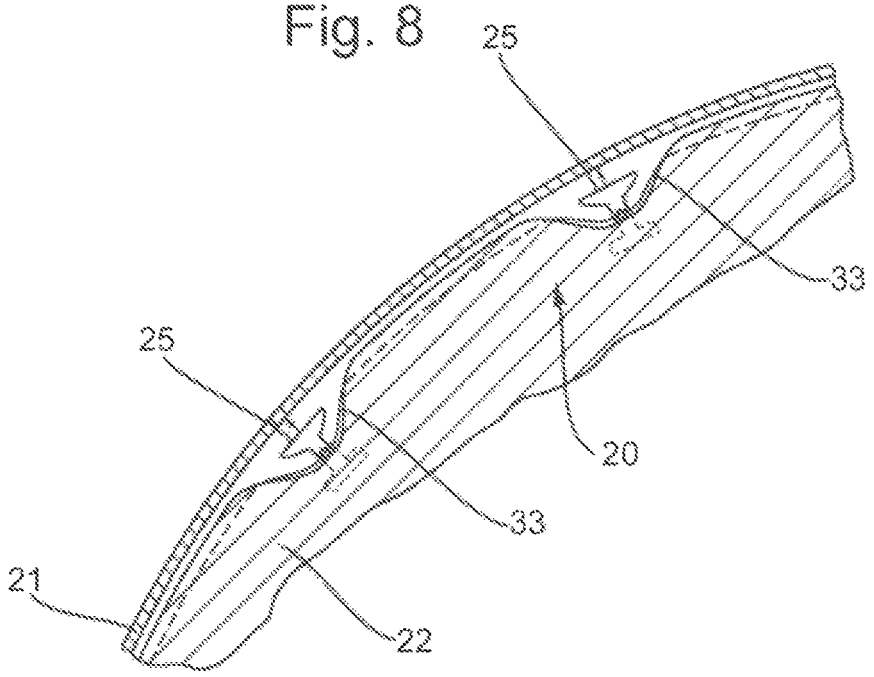
FIG. 8 depicts an arrangement for an impact response adjustment mechanism.

As shown in FIG. 8, in an arrangement, the wire, band or tape may engage with a friction pad 25 such that applying tension to the wire, band or tape 33 forces the friction pad 25 towards the opposing surface. For example, the wire, band or tape may be arranged to be diverted around a part of the friction pad 25. When tension is applied to the wire, band or tape 33, the force has the effect of trying to straighten the wire, band or tape 33, forcing the friction pad 25 to one side, namely in the arrangement depicted in FIG. 8, towards the inner surface of the outer shell 21. It will be appreciated, that as discussed above, reverse configurations may be made, namely in which increasing the tension in the wire, band or tape 33 forces a friction pad 25 mounted on the outer shell 21 towards the outer surface of the inner shell 22.

Figure 9:
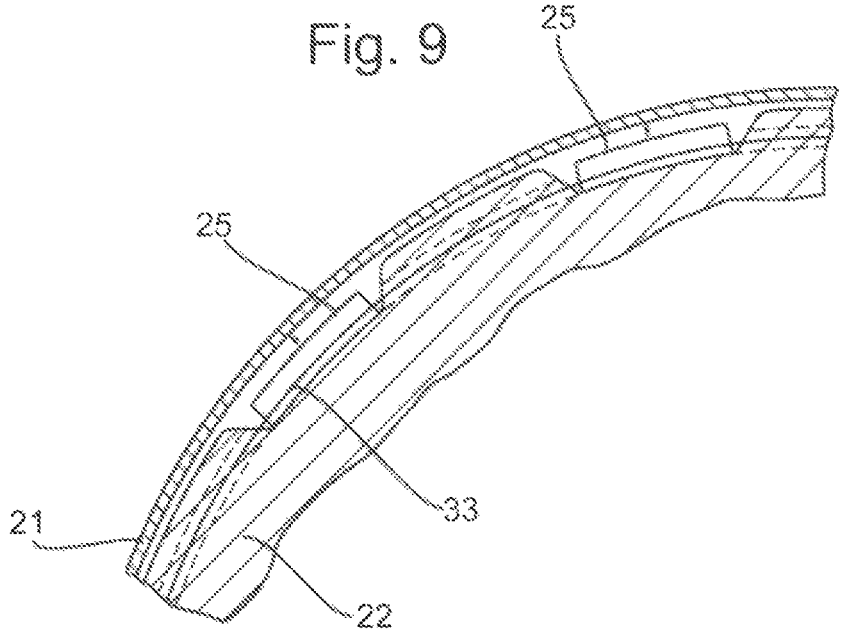
FIG. 9 depicts an arrangement for an impact response adjustment mechanism.

FIG. 9 depicts a further possible variation of an arrangement using a wire, band or tape 33. In particular, the wire, band or tape 33 may be a relatively stiff element that is constrained by the friction pad 25 and the surrounding parts of the shell to which the friction pad 25 is mounted such that it biases the friction pad 25 towards the opposing surface. Accordingly, in the arrangement depicted in FIG. 9, the friction pad 25 is mounted on the inner shell 22 and the stiff wire, band or tape 33 biases the friction pad 25 towards the inner surface of the outer shell 21. Application of a tensile force to the stiff wire, band or tape 33 may reduce the reaction force between the friction pad 25 and the inner surface of the outer shell 21. If the tensile force applied to the stiff wire, band or tape 33 is sufficient, the friction pad 25 may be completely retracted from the opposing surface, namely such that it no longer contacts the inner surface of the outer shell 21.

Figure 10:
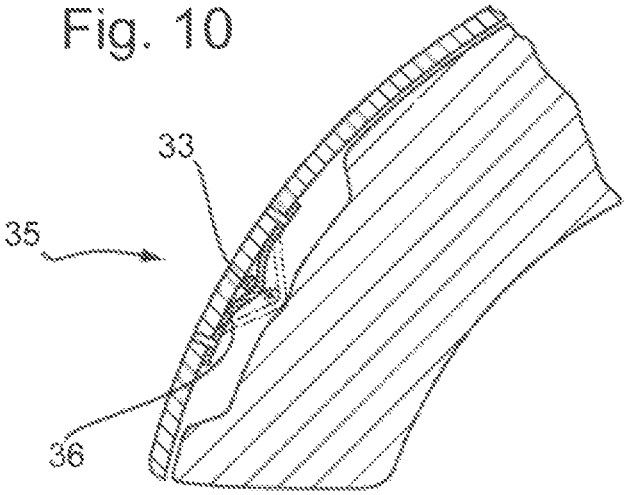
FIG. 10 depicts an arrangement for an impact response adjustment mechanism.

In an arrangement in which a friction pad 25 is connected to a controller 34 by way of a wire, band or tape, alternative arrangements for converting changes of the tension in the wire, band or tape 33 into changes in the reaction force between the friction pad 25 and the opposing surface may be provided. For example, as depicted in FIG. 10, a friction pad 35 may be provided that is configured such that, when the tension in the wire, band or tape 33 is increased, the shape of the friction pad 35 changes. For example, the friction pad 35 may be formed from a pocket of resilient material 36, bounding a portion of the wire, band or tape 33. When the tension in the wire, band or tape 33 increases, it may act against the section of resilient material 36, changing the shape of the friction pad 35, in particular such that the outer surface of the friction pad 35 presses against the opposing surface or presses against it more strongly.

As shown in FIGS. 8 and 9, in an arrangement in which a wire, band or tape 33 connects a controller 34 to a friction pad 25, the impact response adjustment mechanism 20 may include a plurality of friction pads. In such an arrangement, a plurality of friction pads may be connected to a wire, band or tape 33 such that adjusting the tension in the wire, band or tape controls the reaction force between the plurality of friction pads 25 and respective surfaces opposing the friction pads. Alternatively or additionally, the impact response adjustment mechanism 20 may include a plurality of wires, bands or tapes 33, each connected to at least one friction pad 25. Accordingly, a user adjusting the setting of the impact response adjustment mechanism on a single controller may adjust the tension within a plurality of wires, bands or tapes, and, as a result, the reaction force between the friction pads and the respective opposing surfaces.

It should be appreciated that other arrangements may be provided for connecting a controller 34 to be operated by a user and one or more friction pads that form an impact response adjustment mechanism. For example, a tube may be provided between a controller and one or more friction pads. The controller may be configured such that a user may use the controller to adjust the pressure of a fluid such as air, within the tube. The impact response adjustment mechanism may be configured such that the pressure in the tube determines the reaction force between the one or more friction pads and the opposing surface.

Figure 11:
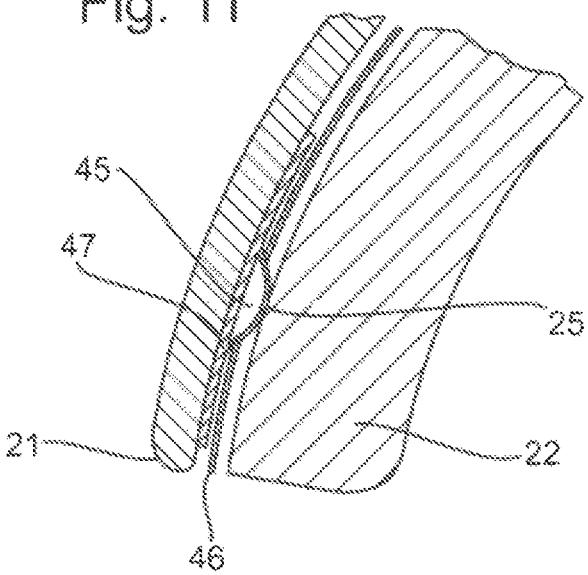
FIG. 11 depicts an arrangement for an impact response adjustment mechanism.

FIG. 11 depicts an example of an arrangement in which the reaction force exerted by a friction pad is controlled by pressure. In the arrangement shown, the friction pad 25 includes an inflatable bladder 45 connected to the outer shell 21. As the pressure inside the inflatable bladder 45 is increased, the reaction force between it and the inner shell 22 is increased. In the arrangement shown, a low friction layer 46 is provided between the inner shell 22 and the outer shell 21 in order to facilitate sliding between the two shells. In such an arrangement, the inflatable bladder 45 may be provided at, and partially protrude through, an opening 47 in the low friction layer 46. It should be appreciated that, in an alternative arrangement, the inflatable bladder may be connected to the inner shell 22.

Figure 12:
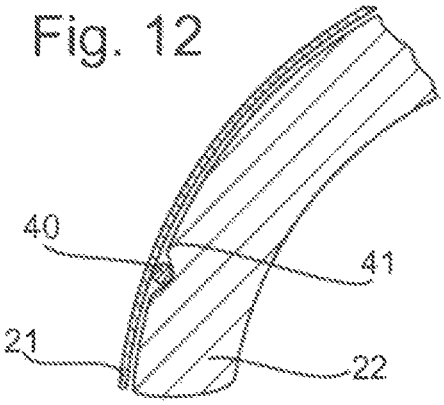
FIG. 12 depicts an arrangement for an impact response adjustment mechanism.

As shown in FIG. 12, in an arrangement a part of the surface of the tube 40 may function as a friction pad. For example, the tube 40 may be mounted within a recess 41 within one of the inner shell 22 and the outer shell 21 and may be formed from a resilient material. Accordingly, as the pressure in the tube 40 increases, the tube 40 expands, which may control the reaction force between part of the tube 40 and an opposing surface. In the arrangement depicted in FIG. 12, the tube 40 is mounted within a recess 41 within the inner shell 22 and the opposing surface is the inner surface of the outer shell 21. It will be appreciated that this arrangement may readily be reversed.

It should also be appreciated that, a controller that is configured to adjust the pressure within a tube 40 may be connected to, and control the pressure within, a plurality of tubes.

Figure 13:
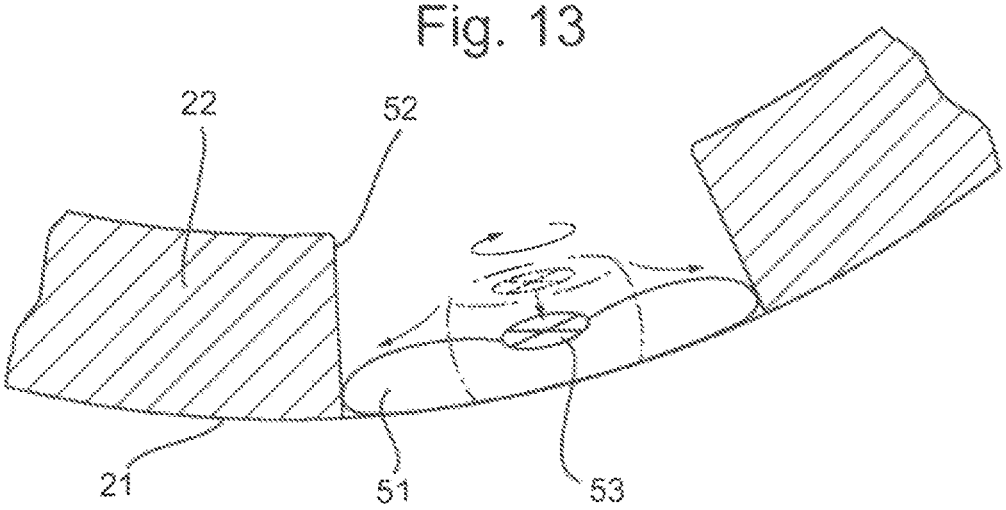
FIG. 13 depicts an arrangement for an impact response adjustment mechanism.

FIG. 13 depicts an alternative arrangement of an impact response adjustment mechanism. In the arrangements shown, the impact response adjustment mechanism includes a deformable member 51 mounted to one of the inner and the outer shell (in the arrangement shown the outer shell 21) and arranged within an opening 52 in the other shell (in the arrangement shown the opening 52 is within the inner shell 22).

In such an arrangement, when the inner and outer shells 21, 22, slide relative to one another, a surface of the deformable member 51 may engage with the surface of the opening 52, affecting the sliding of one shell relative to another as the deformable member 51 deforms.

If the deformable member 51 is smaller than the opening 52, the inner and outer shells 21, 22 may slide relative to one another for a distance corresponding to the initial separation before contact is made between the deformable member 51 and the surface of the opening 52. Accordingly, for an initial distance, the inner and outer shells, 22 may slide relative to one another without interference. At the point at which the deformable member 51 contacts the surface of the opening 52, the sliding of the inner shell relative to the outer shell 22 will be restricted by the extent to which the deformable member 51 deforms.

The impact response adjustment mechanism including a deformable member 51 may include a controller 53 that can deform the deformable member 51 in order to provide a desired setting of the impact response adjustment mechanism.

For example, the controller 53 may deform the shape of the deformable member 51 in order to control the initial separation between an edge of the deformable member 51 and the edge of the opening 52. This may control the extent to which the inner and outer shells 21, 22, may slide relative to one another before the engagement between the deformable member 51 and the edge of the opening 52 starts to affect the sliding of the outer shell 21 relative to the inner shell 22.

Alternatively or additionally, the adjustment by the controller 53 may adjust the pre-stress applied to the deformable member 51. The higher the level of pre-stress applied to the deformable member 51, the greater the force that must be applied to the deformable member 51 by the edge of the opening 52 in order to compress the deformable member 51 a given distance. Accordingly, this may adjust the response profile of the relative displacement over time of the inner and outer shells in response to an impact on the helmet.

In an arrangement, the deformable member 51 may be in contact with the edge of the opening 52 for the full range of settings available to be set by the controller 53. Accordingly, the controller may purely control the pre-stress applied to the deformable member 51.

Alternatively or additionally, the controller 53 may adjust the shape of the deformable member 51 in order to adjust the initial separation between the edge of the deformable member 51 and the opening 52.

Figure 14:
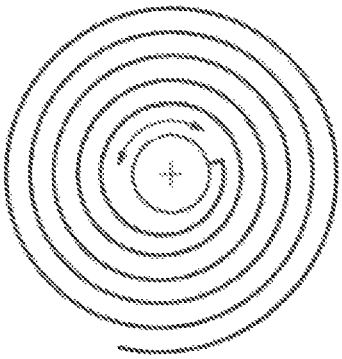
FIG. 14 depicts an arrangement for an impact response adjustment mechanism.

In an arrangement, the deformable member 51 may be formed from a single piece of a deformable material such as an elastomer. Alternatively or additionally, as shown in FIG. 14, the deformable member 51 may include an element such as flat coil spring.

In an arrangement, the impact response adjustment mechanism may include a removable stud that is configured to be removably inserted into a socket in one of the inner shell and outer shell. The impact response adjustment mechanism may be configured such that a part of the stud may engage with a surface on the other of the inner and the outer shell in the event of an impact on the helmet in order to affect the relative sliding of the inner and the outer shell.

Figure 15:
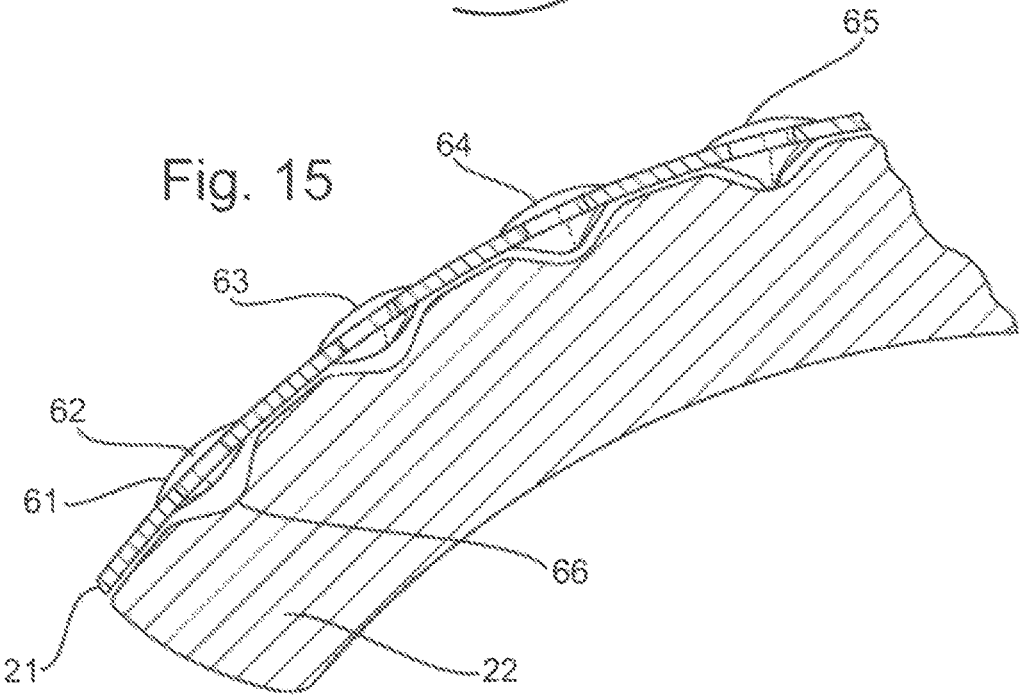
FIG. 15 depicts an arrangement for an impact response adjustment mechanism.

For example, as shown in FIG. 15, the outer shell 21 may include one or more sockets 61, into which a stud 62 may be removably inserted. Part of the stud 62 may protrude into a recess 66 in the inner shell 22. The recess 66 may be arranged such that it is opposite the socket 61 in normal use of the helmet, namely when the helmet has not been subjected to an impact. In the event of an impact, the outer shell 21 may slide relative to the inner shell 22, whereupon the stud 62 may engage with an edge of the recess 66 in the inner shell 22. The engagement of the stud 62 with the edge of the recess 66 may restrict or otherwise affect the sliding of the outer shell 21 relative to the inner shell 22.

The removable stud 62 may be removed and replaced with a different stud 63, 64, 65. The different studs may have different shapes, for example different sized protrusions as depicted in FIG. 15 and/or may have different harnesses. By selecting to insert a particular one of the studs 62, 63, 64, 65, the user may change the setting of the impact response adjustment mechanism.

It should be appreciated that, although FIG. 15 depicts an arrangement with four different studs 62, 63, 64, 65 inserted into respective sockets, in practice, a helmet may have a single socket and the user may select one from a plurality of studs to insert in the socket or may insert no studs in the socket in order to provide the helmet with a desired setting of the impact response adjustment mechanism.

In other arrangements, a helmet may have a plurality of sockets and the user may select desired studs for one or more of those sockets as appropriate. In an arrangement, a user may be provided with a sufficient number of studs of each type that each socket may be provided with the same type of stud.

In the arrangement shown in FIG. 15, the sockets may be simple holes, through which deformable studs may be forced in order to attach or remove the studs from the sockets. Alternatively, other attachment arrangements may be provided, such as, for example, providing the sockets and studs with threaded sections such that the studs can be removably screwed into the socket.

The invention claimed is:

1. A helmet comprising:

an inner shell;

an outer shell, configured to be able to displace relative to the inner shell in response to an impact;

a sliding interface between the inner shell and the outer shell; and an impact response adjustment mechanism configured to be adjustable such that the response profile of the relative displacement over time of the outer shell in relation to the inner shell in response to an impact on the helmet varies depending on the setting of the impact response adjustment mechanism, wherein the impact response adjustment mechanism is configured to be manually adjustable by a wearer of the helmet;

wherein the impact response adjustment mechanism comprises a friction pad mounted on one of the inner shell and outer shell, and a controller such that the controller is configured to be operated by the wearer of the helmet;

wherein the friction pad is configured to be contactable with an opposing surface formed on, or connected to, the one of the inner shell and outer shell to which the friction surface is not connected;

wherein the impact response adjustment mechanism is configured such that it can adjust the friction between the friction pad and the opposing surface to adjust the response profile of the relative displacement over time of the outer shell in relation to the inner shell in response to an impact on the helmet; and the controller is configured to control the friction pad to adjust the reaction force between the friction pad and the opposing surface.

2. A helmet according to claim 1, wherein the impact response adjustment mechanism is configured to be able to adjust the reaction force between the friction pad and the opposing surface.

3. A helmet according to claim 2, wherein the impact response adjustment mechanism comprises a rotating actuator that, on rotation in respective first and second directions, retracts and advances the friction pad in order to adjust the reaction force between the friction pad and the opposing surface.

4. A helmet according to claim 1, wherein the impact response adjustment mechanism comprises a wire, band or tape connecting the controller and the friction pad; and the tension in the wire, band or tape determines the reaction force between the friction pad and the opposing surface.

5. A helmet according to claim 4, wherein the impact response adjustment mechanism comprises a plurality of friction pads and the wire, band or tape is connected to said plurality of friction pads.

6. A helmet according to claim 4, wherein the controller is connected to a plurality of wires, bands or tapes, each of which is connected to said friction pad, or wherein the impact response adjustment mechanism comprises a plurality of friction pads and a plurality of wires, bands or tapes, each of which is connected to at least one friction pad of said plurality of friction pads.

7. A helmet according to claim 1, wherein the impact response adjustment mechanism comprises a tube connecting the controller and the friction pad; and the impact response adjustment mechanism is configured such that the pressure in the tube determines the reaction force between the friction pad and the opposing surface.

8. A helmet according to claim 7, wherein the surface of the tube forms a friction pad.

9. A helmet according to claim 7, wherein the controller is connected to a plurality of tubes, each of which is connected to at least one friction pad.

10. A helmet according to claim 1, wherein the impact response adjustment mechanism comprises a deformable member mounted to a surface of one of the inner shell and the outer shell at an interface between the shells and within an opening formed in the other of the inner shell and the outer shell; and the impact response adjustment member is configured such that, after an impact on the helmet that causes the outer shell to displace relative to the inner shell, the deformable member exerts a force on side walls of the opening.

11. A helmet according to claim 10, wherein the deformable member is in contact with the walls of the opening in the absence of an impact on the helmet that causes the outer shell to displace relative to the inner shell.

12. A helmet according to claim 10, wherein the impact response adjustment mechanism is configured such that the deformable member can be deformed to adjust the separation between an edge of the deformable member and the side walls of the opening in the absence of an impact on the helmet that causes the outer shell to displace relative to the inner shell.

13. A helmet according to claim 10, wherein the impact response adjustment mechanism is configured such that it can adjust a pre-stress applied to the deformable member in the absence of an impact on the helmet that causes the outer shell to displace relative to the inner shell.

14. A helmet according to claim 1, wherein the impact response adjustment mechanism is configured to be adjustable without requiring the use of a tool.

15. A helmet comprising:

an inner shell;

an outer shell, configured to be able to displace relative to the inner shell in response to an impact;

a sliding interface between the inner shell and the outer shell; and an impact response adjustment mechanism configured to be adjustable such that the response profile of the relative displacement over time of the outer shell in relation to the inner shell in response to an impact on the helmet varies depending on the setting of the impact response adjustment mechanism, wherein the impact response adjustment mechanism is configured to be manually adjustable by a wearer of the helmet;

wherein the impact response adjustment mechanism comprises a socket disposed in at least one of the inner shell and the outer shell;

a removable stud, configured to be removably inserted into the socket; and the impact response adjustment mechanism is configured such that, after an impact on the helmet that causes the outer shell to displace relative to the inner shell, the stud comes into contact with an opposing surface on the one of the inner shell and the outer shell that does not include the socket.

16. A helmet according to claim 15, comprising a plurality of studs of different shapes, wherein any one of said plurality of studs may be removably inserted in said socket.

17. A helmet according to claim 15, comprising a plurality of studs of different hardness, wherein any one of said plurality of studs may be removably inserted in said socket.

18. A helmet according to claim 15, wherein the impact response adjustment mechanism comprises a plurality of said sockets.

* * * * *